US005941579A

United States Patent [19]

Baniak

[11] Patent Number: 5,941,579

[45] Date of Patent: Aug. 24, 1999

[54] VEHICLE DOOR LATCH WITH REDUCED RELEASE EFFORT

[75] Inventor: Grzegorz Baniak, Etobicoke, Canada

[73] Assignee: Atoma International Corp., Newmarket, Canada

[21] Appl. No.: 09/137,569

[22] Filed: Aug. 21, 1998

Related U.S. Application Data

[60] Provisional application No. 60/056,506, Aug. 21, 1997.

[51] Int. Cl.[6] ..... E05C 3/06

[52] U.S. Cl. ..... 292/216; 292/201

[58] Field of Search ..... 292/216, 201, 292/DIG. 23, DIG. 42, DIG. 43, 239, 79, 73

[56] References Cited

U.S. PATENT DOCUMENTS 4,386,798 6/1983 Ménard ..... 292/216
5,071,178 12/1991 Brackman et al. ..... 292/216
5,273,325 12/1993 Zimmerman ..... 292/216
5,522,626 6/1996 Dominique ..... 292/216

*Primary Examiner*—Steven Meyers
*Assistant Examiner*—Teri Pham
*Attorney, Agent, or Firm*—Howard & Howard

[57] ABSTRACT

A latch assembly (10) has a housing (12) having a mouth (14). A detent fork (16) is pivotally mounted within the housing (12) to cooperate with the mouth (14) to pivot between an open and closed condition for receiving, engaging and cinching a keeper (60) of a striker. The detent fork (16) is biased in the open condition. A pivotally mounted pawl (24) is biased for engagement with a pin (26). The pin (26) is slidably mounted within a guideway (38) and positioned between the detent fork (16) and the pawl (24). The pin (26) cooperates with the pawl (24) to retain the detent fork (16) in the closed condition. The pin (26) rolls between the pawl (24) and detent fork (16) as the pawl (24) is rotated in a releasing sense to disengage the detent fork (16).

9 Claims, 9 Drawing Sheets

VEHICLE DOOR LATCH WITH REDUCED RELEASE EFFORT

This application claims benefit of Provisional Appl. 60/056,506 filed Aug. 21, 1997.

FIELD OF INVENTION

This invention relates to a latch for a vehicle door. In particular, this invention relates to a latch that can be released with a relatively reduced amount of effort.

BACKGROUND OF INVENTION

Vehicle door latch systems are well known in the art. Typically, a vehicle hood or trunk deck will have a latch for engaging and cinching onto a striker. The latch will have a rotatably mounted detent fork engaging a pawl in a ratchet relation. The detent fork cooperates with a mouth of the housing to pivot between an open and closed condition for receiving, engaging and cinching a keeper of a striker. The detent fork has a cam surface having abutment surfaces. As the detent fork engages the keeper of a striker, the detent fork rotates in a latching sense and the pawl travels along the cam surface to retain the detent fork in the closed and cinched conditions.

To release the latch, the pawl is rotated to disengage the detent fork. The pawl must overcome the frictional engagement between the pawl and the detent fork. Additionally, the pawl must counter-rotate the detent fork before the pawl becomes disengaged. The amount of effort required to release the detent fork is thus proportional to the size of the spring which biases the detent fork and the length of the lever arm of the pawl.

The lever arm of the pawl can be lengthened in order to minimize the effort. However, the throw of the release handle is also increased or will require additional linkages to operate, both of which may not be desirable. Alternatively, the strength of the spring could be reduced to meet the Federal Motor Vehicle Safety Standards (FMVSS) minimum.

SUMMARY OF THE INVENTION

The disadvantages of the prior art may be overcome by providing a latch assembly for a vehicle having a mechanism for reducing the effort to release a pawl from a detent fork.

According to one aspect of the invention, there is provided a latch assembly having a housing having a mouth. A detent fork is pivotally mounted within the housing to cooperate with the mouth to pivot between an open and closed condition for receiving, engaging and cinching a keeper of a striker. The detent fork is biased in the open condition. A pivotally mounted pawl is biased for engagement with a pin. The pin is slidably mounted within a guideway and positioned between the detent fork and the pawl. The pin cooperates with the pawl to retain the detent fork in the closed condition. The pin rolls between the pawl and detent fork as the pawl is rotated in a releasing sense to disengage the detent fork.

DESCRIPTION OF THE DRAWINGS

In drawings which illustrate embodiments of the invention.

DESCRIPTION OF THE INVENTION

Figure 1:
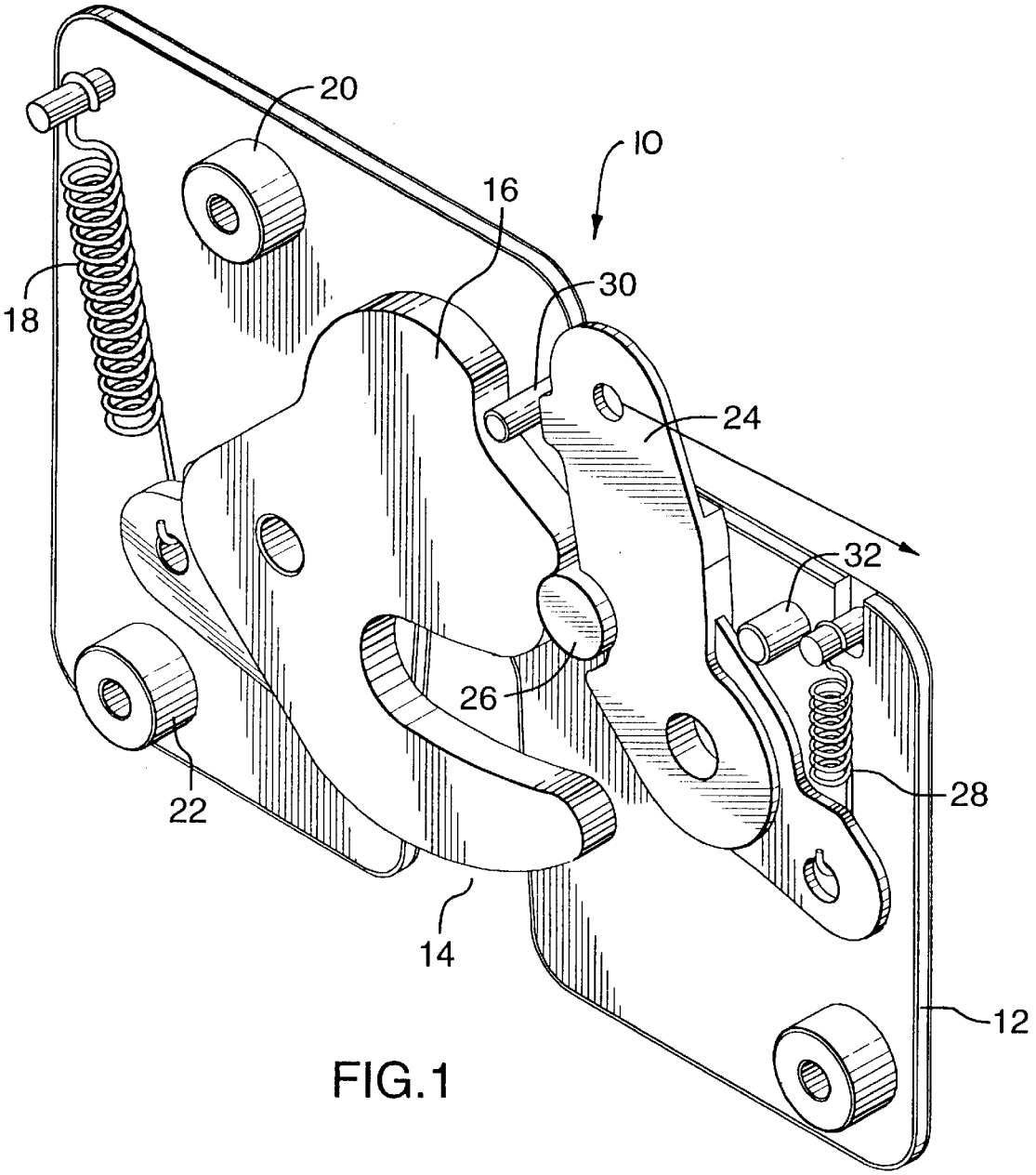
FIG. 1 is a perspective view of the latch assembly of the present invention, with the front cover plate removed.

The latch 10 of the present invention is generally illustrated in FIG. 1. The latch 10 has a housing 12 having a mouth 14. A detent fork 16 is pivotally mounted on the housing 12. Spring 18 is connected between the detent fork 16 and housing 12 to bias detent fork 16 in an open condition.

Detent fork 16 cooperates with the mouth 14 to receive, engage and cinch a keeper of a striker. Bumpers 20 and 22 limit the rotational travel of the detent fork 16. Bumper 20 limits the closing travel of the detent fork 16 and positions the detent fork 16 in a closed condition and protects the latch 10 and cases of overslamming of the closure. Bumper 22 limits opening travel and positions detent fork 16 in an open condition ready to receive the striker.

Pawl 24 is pivotally mounted on the housing 12 on an opposite side of the mouth 14 from detent fork 16. Pawl 24 in cooperation with pin 26 coact with the detent fork 16 is a ratchet manner, as will be described below. Pawl 24 has a spring 28 which biases the pawl in a latching sense to engage the pin 26. Housing 12 has bumpers 30 and 32 which limit rotational travel of the pawl 24. Bumper 30 limits closing travel, while bumper 32 limits opening travel.

Figure 2:
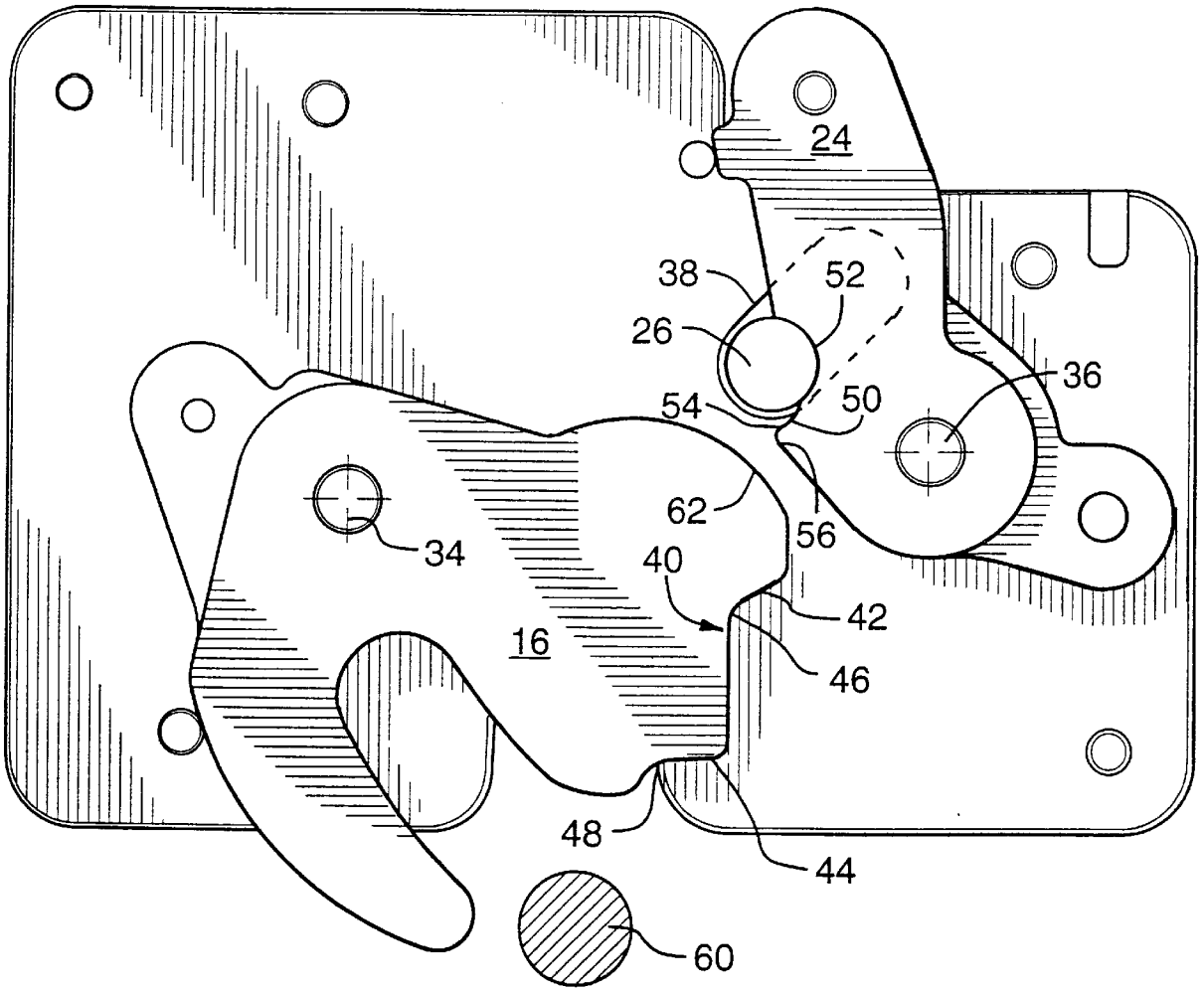
FIG. 2 is a front elevational view of the latch assembly of FIG. 1 in a fully open condition.

Referring to FIG. 2, detent fork 16 is pivotally mounted to the housing at pin 34 and rotates in either a latching sense or a releasing sense. Pawl 24 is pivotally mounted to housing 12 at pin 36. Opposite inner faces of housing 12 has a guideway or groove 38 for receiving pin 26. Guideway 38 positions pin 26 substantially parallel to the pins 34 and 36 and allows pin 26 to slide therealong between a detent fork engaging position and a release or disengage position.

Detent fork 16 has a cam surface 40 having a secondary detent 42 and a primary detent 44. Trailing the secondary detent 42 is an arcuate secondary abutment surface 46. Similarly, trailing the primary detent 44 is an arcuate primary abutment surface 48. Abutment surfaces 46 and 48 each have a radius approximately equal to the radius of the pin 26 for nestingly receiving the pin 26.

Pawl 24 has a cam surface 50. Cam surface 50 has an arcuate abutment 52 merging smoothly with an arcuate rolling surface 54, terminating in a releasing detent 56. Arcuate abutment 52 and arcuate rolling surface 54 each have a radius approximately equal to that of pin 26. Abutment 52 has a circumferential extent sufficient to receive and cradle pin 26.

Figure 3:
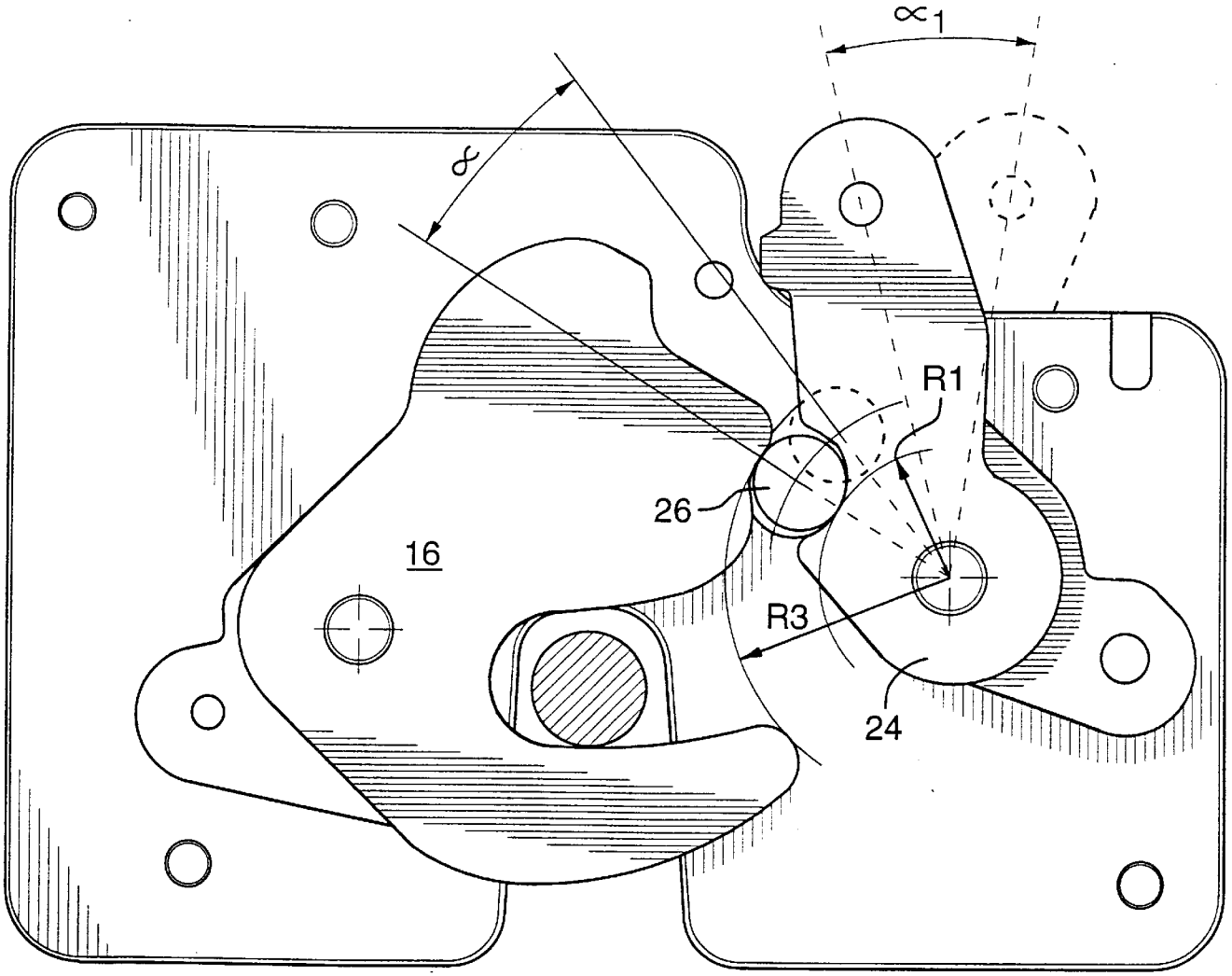
FIG. 3 is a front elevational view of the latch assembly of FIG. 1.

The pin 26 is preferably sized according to the radial lengths as shown in FIG. 3. Radial length R3 must be sufficient to engage detent fork 16 in a ratchet engagement. Additionally, the diameter of the pin (R3–R1) is related to the angular travel of the pawl 1 and the angular travel of the pin 26 2 as follows:

$\{1/2\}=\{1+R3/R1\}$

Figure 4:
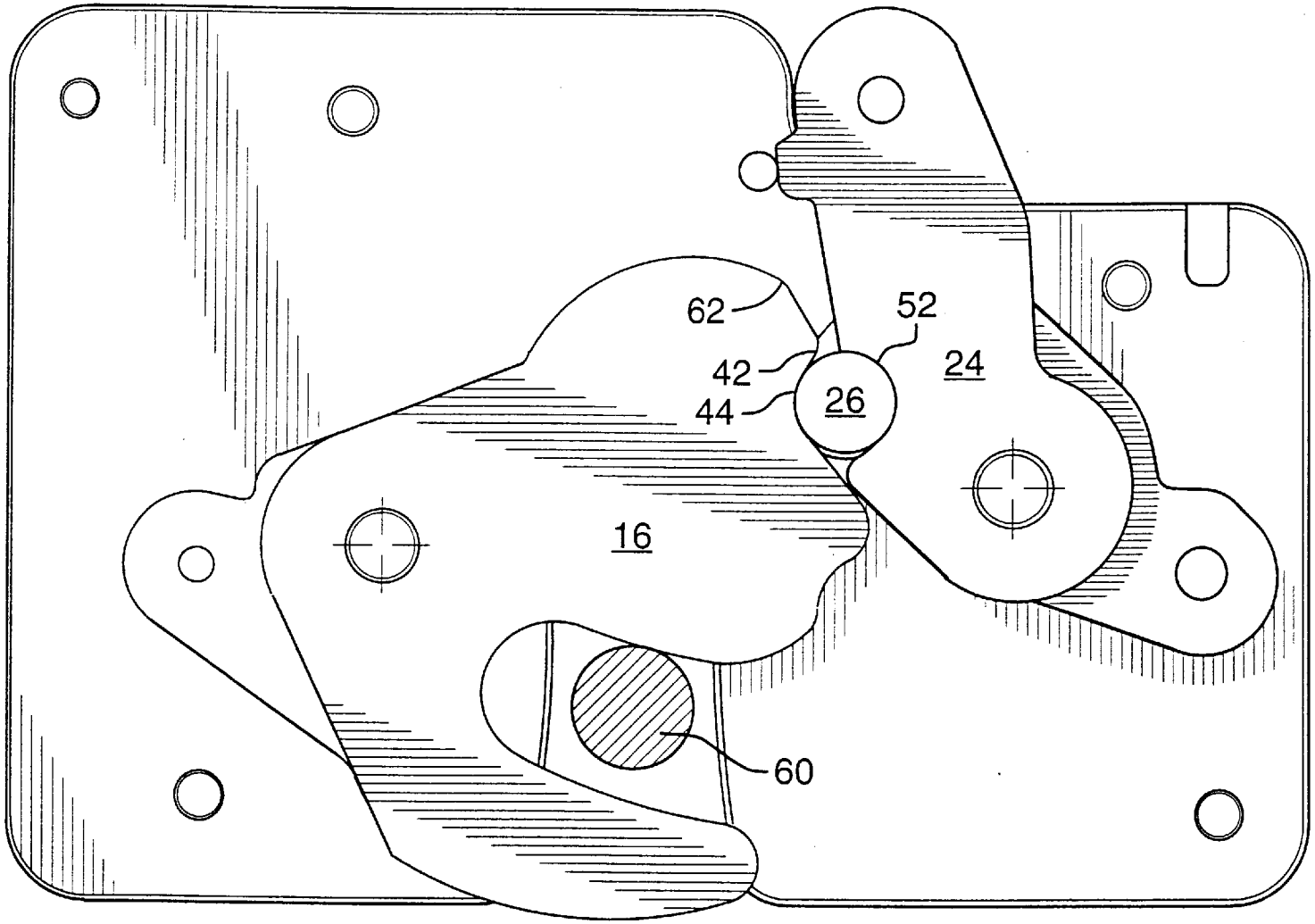
FIG. 4 is a front elevational view of the latch assembly of FIG. 1 in a secondary closed condition.
Figure 5:
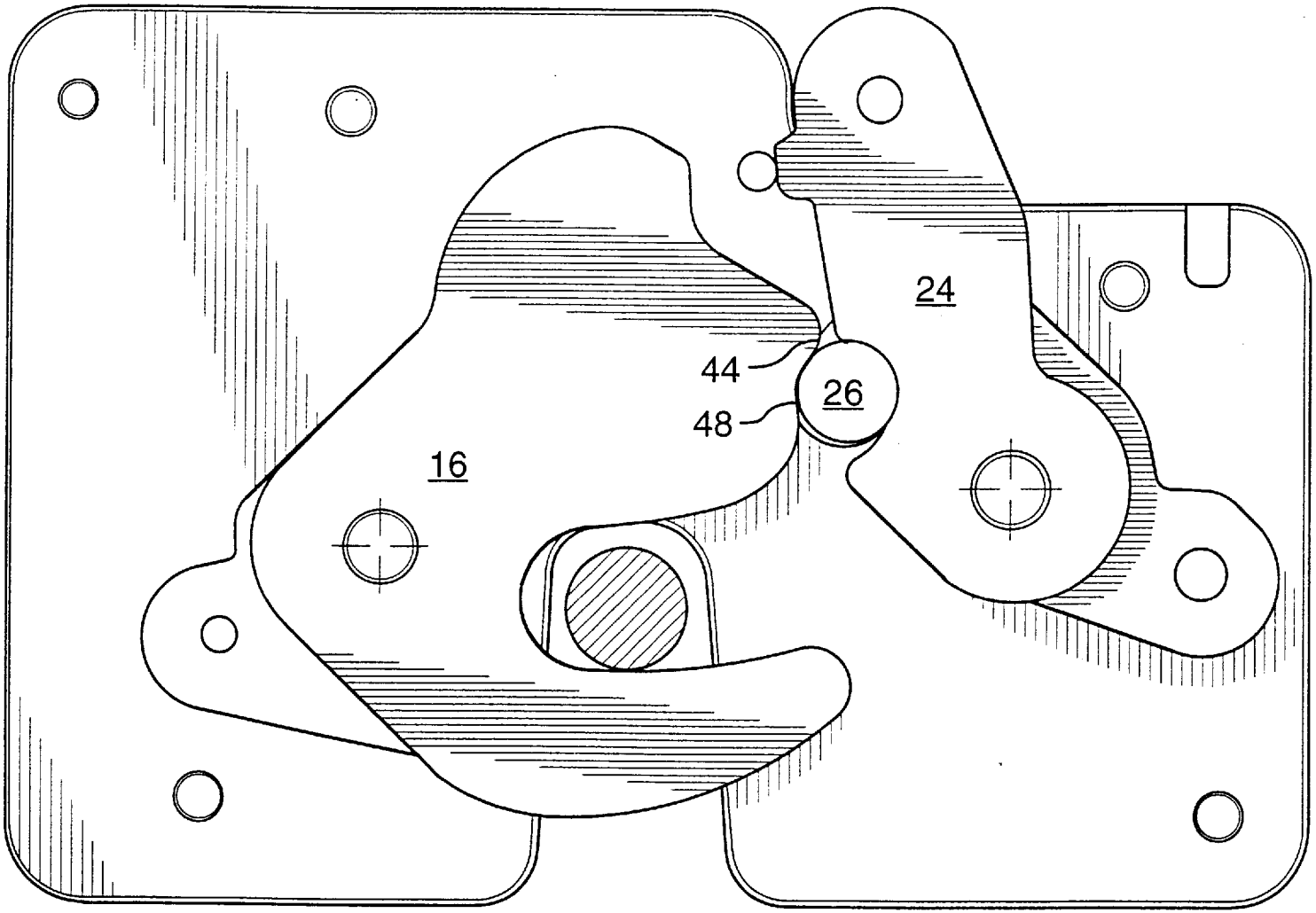
FIG. 5 is a front elevational view of the latch assembly of FIG. 1 in a primary closed condition.
Figure 6:
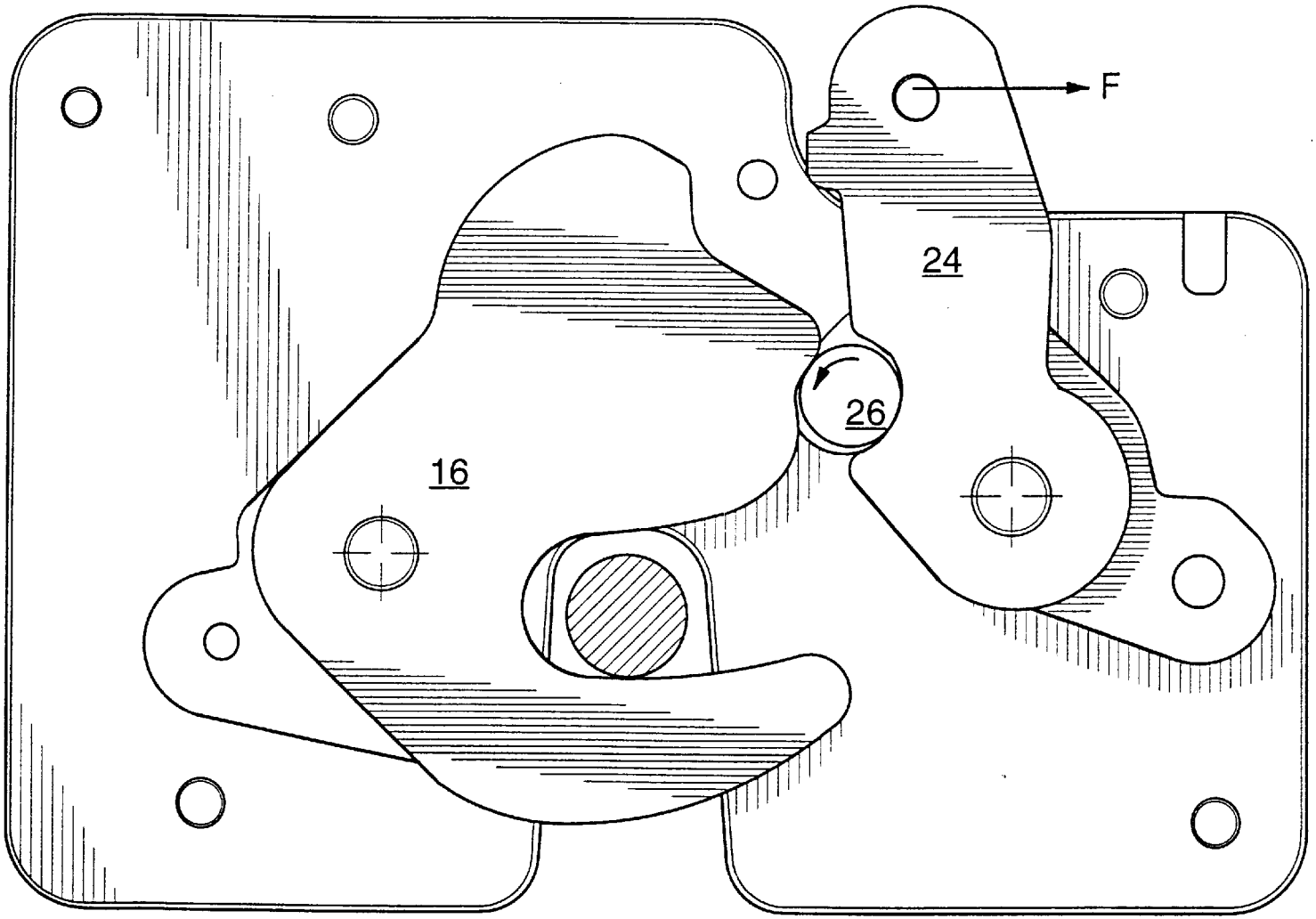
FIG. 6 is a front elevational view of the latch assembly of FIG. 1 in a releasing condition.
Figure 7:
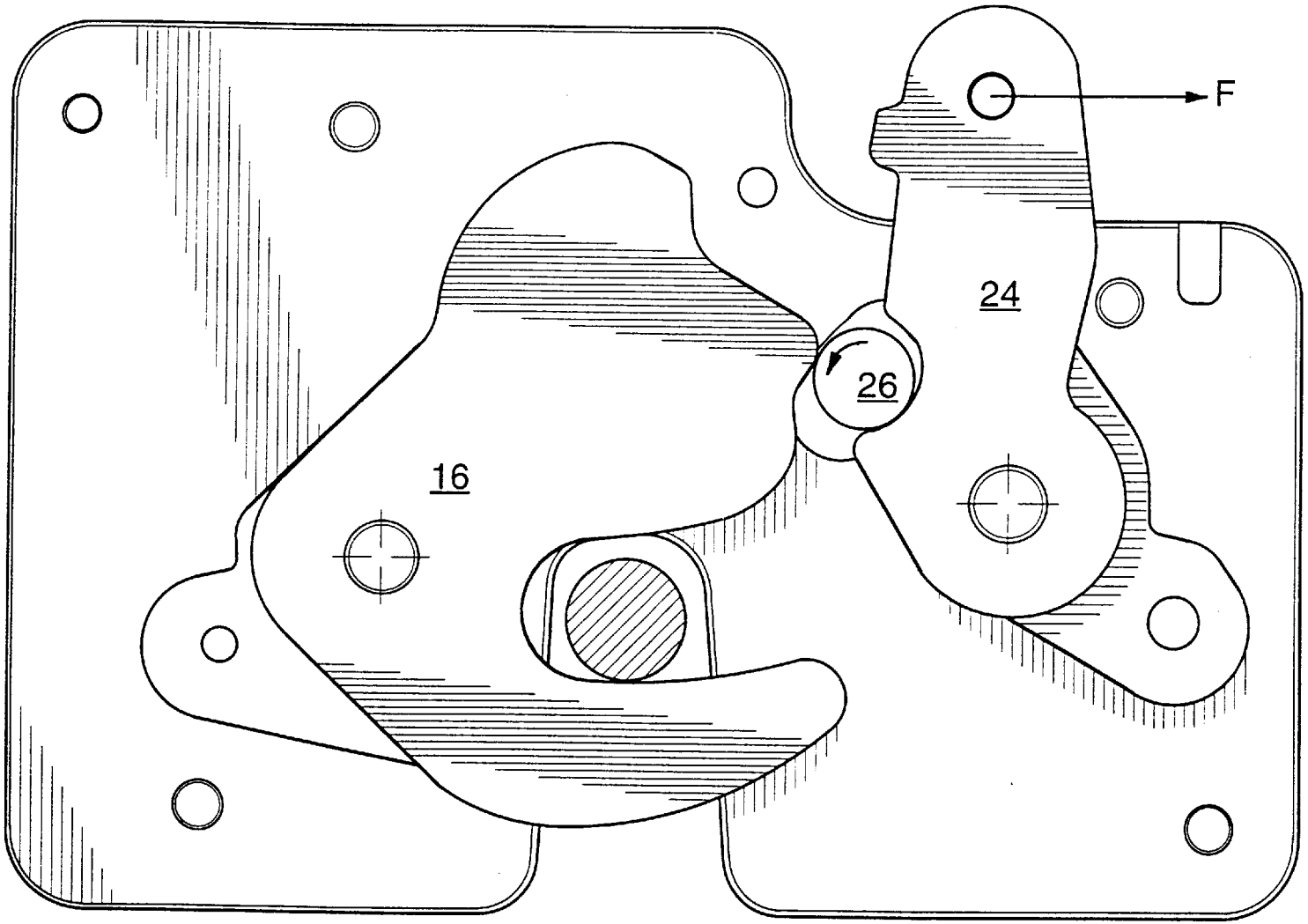
FIG. 7 is a front elevational view of the latch assembly of FIG. 1 in a releasing condition.
Figure 8:
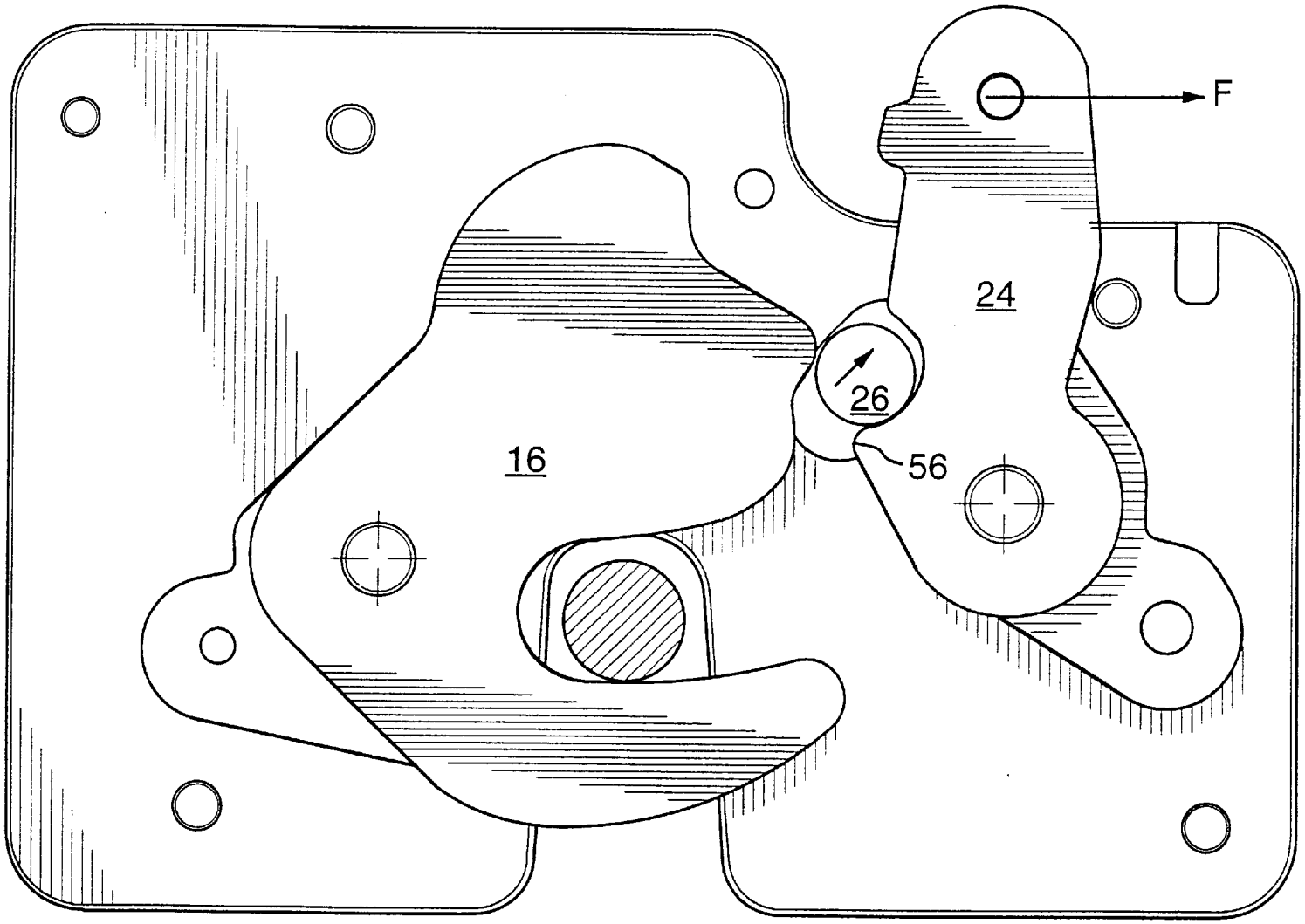
FIG. 8 is a front elevational view of the latch assembly of FIG. 1 in a near release condition.
Figure 9:
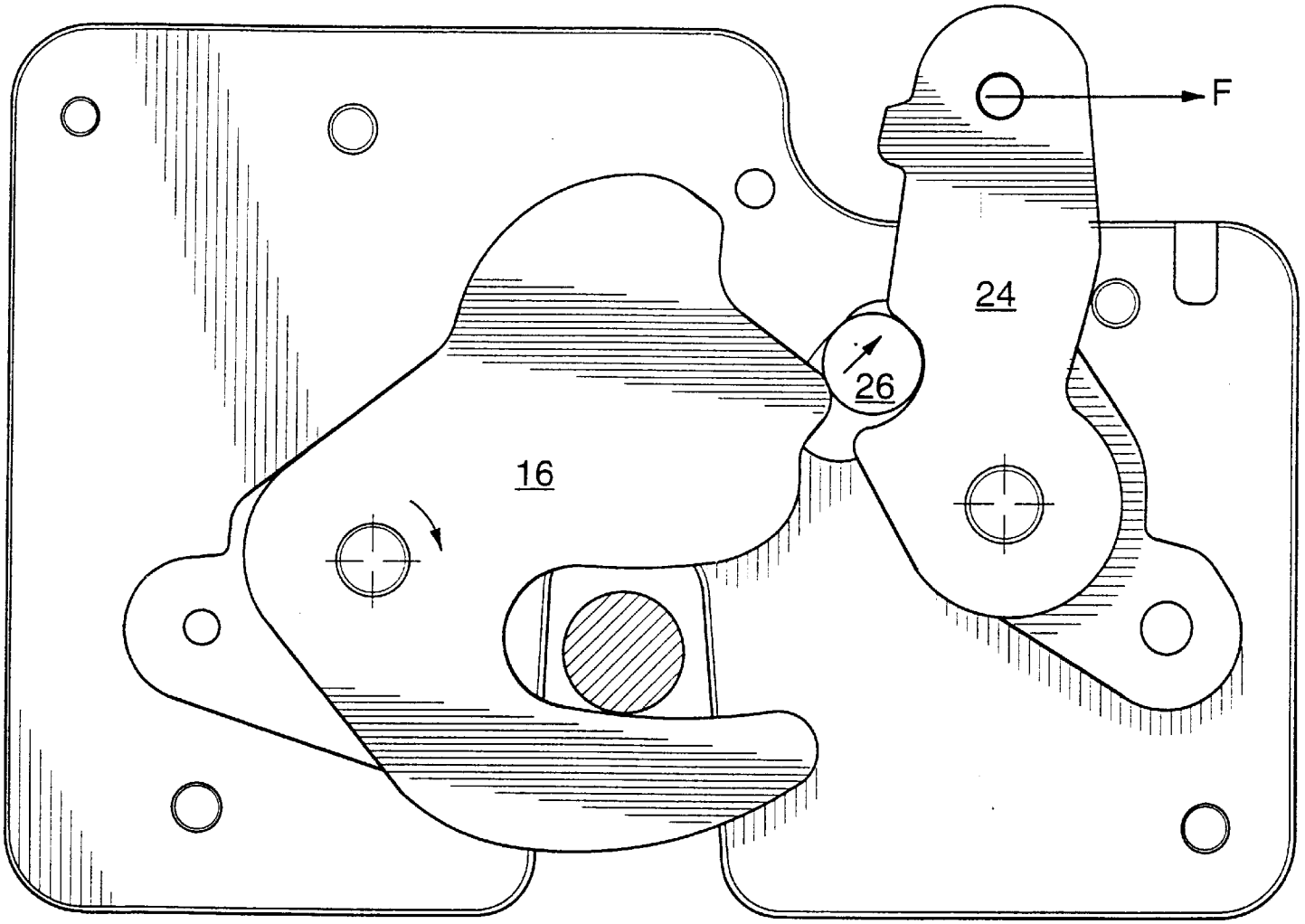
FIG. 9 is a front elevational view of the latch assembly of FIG. 1 in a released or open condition.

As the latch receives the keeper 60 as illustrated in FIG. 4, the closing motion will urge detent fork 16 to rotate in a latching sense. The leading edge 62 of detent fork 16 will frictionally engage pin 26 and will push the pin 26 into the abutment 52 of cam surface 50. The detent fork 16 will travel relatively to the pin 26 until the pin 26 passes the secondary detent 42. The bias of spring 28 will cause the pawl 24 to rotate in a latching sense urging pin 26 into engagement with the secondary abutment 46. In this position, pin 26 abuts detent fork 16, cooperating with pawl 24 to resist counter rotation (i.e. in a releasing sense) of the detent fork 16 retaining the detent fork 16 in a secondary latched condition.

Further closing rotation of the detent fork 16 in a closing sense will push the pawl 24 against the bias of spring 28. Cam surface 40 will frictionally engage pin 26 as detent fork 16 continues to rotate beyond detent 44. Again the bias of spring 28 will cause pawl 24 to rotate urging pin 26 into engagement with the primary abutment 48 to a closed condition. In this closed condition, the detent fork 16 is in full engagement with the keeper 60 of the striker. Pawl 24 and pin 26 abut detent fork 16, cooperate to resist counter rotation of the detent fork 16.

Referring to FIGS. 6 to 9, the latch 10 is released by applying a releasing force F to the distal end of pawl 24 in a releasing sense. Rotation of the pawl in the releasing sense will cause pin 26 to rotate relative thereto. Pin 26 will rollingly travel along the cam surface 50 from the abutment 52 towards the rolling surface 54. Similarly, pin 26 will travel along cam surface 40 from the abutment surface 48 towards the detent 44 until it disengages with the detent fork 16. Since this motion is a rolling motion, there are minimal frictional forces involved and requires a relatively minimal amount of effort.

Preferably, the pin 26 rollingly engages the cam surface 40 until the pin 26 abuts releasing detent 56 which will position the pin 26 in a near release condition. As is apparent, the length of cam surface 40 and the circumferential extent of pin 26 are related to properly position pin 26 in the near release condition. In this near release condition, pin 26 is fully cradled within rolling surface 54. Pawl 24 and pin 26 will still be in an over center condition and as such will resist counter rotation of the detent fork 16. The releasing detent 56 will prevent further rotation of the pin 26. Continued application of the releasing force F will cause pin 26 to slide a relatively short distance from an over center condition to beyond center and will release detent fork 16 releasing the keeper 60 of the striker. In this manner, the overall effort of the latch 10 is reduced but a final release effort is required to fully release the latch preventing inadvertent or accidental release.

The preceding specific embodiment is illustrative of the practice of the present invention. It is to be understood, however, that other expedients known or apparent to those skilled in the art or disclosed herein may be employed without departing from the spirit of the invention.

We claim:

1. A latch assembly comprising:

a housing having a mouth, a detent fork pivotally mounted within the housing to cooperate with the mouth to pivot between an open condition and a closed condition for receiving, engaging and cinching a keeper of a striker, said detent fork biased to the open condition, a pin slidably mounted within a guideway and slidable between a detent fork engaging position and a disengage position, and a pivotally mounted pawl engaging the pin, said pawl biased to urge the pin to the detent fork engaging position, said pin positioned between the detent fork and pawl and cooperating with the pawl to retain the detent fork in the closed condition upon the detent fork rotating in a latching sense towards the closed position, said pin rolling between the pawl and detent fork from the detent fork engaging position to a near release position as the pawl is rotated in a releasing sense, and further rotation of the pawl in the releasing sense urges the pin to move from the near disengage position to the disengage position releasing the detent fork.

2. A latch assembly as claimed in claim 1 wherein said pawl has a cam surface having a releasing detent, said pin rollingly engages the cam surface and abuts the releasing detent as the pawl rotates in the releasing sense.

3. A latch assembly as claimed in claim 1 wherein said pawl has a cam surface having a releasing detent at one end thereof and an abutment at an opposite end thereof, said pin rollingly engages the cam surface between the releasing detent and the latching detent as the pawl is rotated.

4. A latch assembly as claimed in claim 3 wherein the pin engages the abutment when the detent fork is retained in the closed condition and the pin engages the releasing detent as the pawl is further rotated in the releasing sense releasing the detent fork.

5. A latch assembly as claimed in claim 4 wherein the detent fork has a primary detent for engaging the pin to retain the detent fork in the closed condition and a secondary detent for engaging the pin to retain the detent fork in a secondary latched condition.

6. A latch assembly comprising:

a housing having a mouth, a detent fork pivotally mounted within the housing to cooperate with the mouth to pivot between an open condition and a closed condition for receiving, engaging and cinching a keeper of a striker, said detent fork biased to the open condition, a pin slidably mounted within a guideway and slidable between a detent fork engaging position and a disengage position, and a pivotally mounted pawl engaging the pin, said pawl biased to urge the pin to the detent fork engaging position, said pin positioned between the detent fork and pawl and cooperating with the pawl to retain the detent fork in the closed condition upon the detent fork rotating in a latching sense towards the closed position, said pin rolling between the pawl and detent fork from the detent fork engaging position to the disengage position releasing the detent fork as the pawl is rotated in a releasing sense.

7. A latch assembly as claimed in claim 6 wherein said pawl has a cam surface having an abutment at one end, said pin rollingly engages the cam surface and abuts the abutment as the pawl rotates in the latching sense.

8. A latch assembly as claimed in claim 7 wherein the pin engages the abutment when the detent fork is retained in the closed condition.

9. A latch assembly as claimed in claim 8 wherein the detent fork has a primary detent for engaging the pin to retain the detent fork in the closed condition and a secondary detent for engaging the pin to retain the detent fork in a secondary latched condition.

* * * * *